United States Patent [19]

Wright, Jr. et al.

[11] Patent Number: 4,660,471

[45] Date of Patent: Apr. 28, 1987

[54] PRINTING APPARATUS

[75] Inventors: James L. Wright, Jr., 2020 N. Weber, Colorado Springs, Colo. 80907; Hakon Christiansen, Colorado Springs, Colo.

[73] Assignee: James L. Wright, Jr., Colorado Springs, Colo.

[21] Appl. No.: 558,929

[22] Filed: Dec. 7, 1983

[51] Int. Cl.[4] ..... B41F 5/04

[52] U.S. Cl. ..... 101/219; 101/228; 101/351; 101/350; 400/685; 400/613.2

[58] Field of Search ..... 400/685, 692, 613.2; 101/212, 216, 218, 219, 247, 228, 350, 351

[56] References Cited

U.S. PATENT DOCUMENTS

| | | | |
|---|---|---|---|
| 287,383 | 10/1883 | Kendall et al. | 101/219 |
| 1,019,107 | 3/1912 | White | 101/219 |
| 1,584,578 | 5/1926 | Widenmann et al. | 101/247 |
| 1,648,534 | 11/1927 | Breusch | 101/329 |
| 1,750,357 | 3/1930 | Ramdor | 101/247 |
| 2,181,435 | 11/1939 | Loris | 101/329 |
| 2,713,304 | 7/1955 | Thomas | 101/247 |
| 3,306,195 | 2/1967 | Cutri | 101/247 |
| 3,364,849 | 1/1968 | Price, Jr. | 101/329 |
| 3,373,684 | 3/1968 | Fisher | 101/228 |
| 3,440,955 | 4/1969 | Howard et al. | 400/613.2 |
| 3,487,776 | 1/1970 | Marozzi | 101/219 |
| 3,603,250 | 9/1971 | Knudsen | 101/219 |
| 3,651,503 | 3/1972 | Kono | 101/66 |
| 4,022,124 | 5/1977 | Knudsen | 101/348 |
| 4,137,844 | 2/1979 | Paulson | 101/229 |

FOREIGN PATENT DOCUMENTS

| | | | |
|---|---|---|---|
| 204964 | 10/1923 | United Kingdom | 400/685 |

OTHER PUBLICATIONS

Ryan et al., "Forms Stacking Aid", IBM Technical Disclosure Bulletin, vol. 20, No. 1, p. 97, 6/77.

*Primary Examiner*—William Pieprz
*Attorney, Agent, or Firm*—Timothy J. Martin

[57] ABSTRACT

A printing apparatus includes a print roller, a platen roller and an ink roller mounted between a pair of upright supports secured to a support surface. The platen roller is resiliently biased against the print roller, and is preferably supported independently of the upright supports by a spring-biased lever and cam assembly. The printing apparatus is especially constructed for printing accordian arrays of cards, having delicate masking material thereon, and includes a feed tray with a feed stop and a take-up tray with a take-up stop each located at a position within a defined ratio with respect to the length of a single card in the array. The platen roller is preferably biased within a selected range to prevent damage to the masking material. A drive mechanism rotates the print roller which, in turn, drives the platen roller either by direct pressure or through gears.

18 Claims, 9 Drawing Figures

PRINTING APPARATUS

BACKGROUND OF THE INVENTION

The present invention is directed to a printing apparatus adapted to print information on a print media in a simple and efficient manner. The device is engineered for inexpensive manufacture in order to render the printing apparatus available for use by small proprietors and businesses. The printing apparatus is constructed for use with specialty print media, such as lottery cards, wherein it is important that the integrity of the print media not be damaged when identification information is printed thereon.

The printing industry has become increasingly pervasive in modern times, yet there remains a need for small automated printing units that are economical in construction giving individuals and small business entities the ability to purchase such device for use in low volume printing tasks. Although some printing devices have been developed in the past which are fairly small and compact, there apparently is no wide spread use of these devices in small business applications. An example of such a hand operated printing device is shown in U.S. Pat. No. 835,903 issued Nov. 13, 1906 to W. C. Grant. The device according to this patent includes a hand driven platen roller and an upper print roller carrying printing elements. The print roller is secured to a pair of upright supports by means of a spring biased mechanism pressing the printing elements against the platen roller. Inking rollers distribute a print fluid onto the printing elements.

Another apparatus is shown in U.S. Pat. No. 872,302 issued Nov. 26, 1907 to M. McMahon. In the McMahon patent, a print roller is formed of a half cylinder and is mounted between a pair of upright supports. The print roller carries a printing element that contacts an inking roller which coats the printing element with printing fluids as the print roller is rotated by a hand crank. A platen roller is upwardly biased between a pair of vertical supports so that it may contact the printing element as it is rotated.

Despite the structure shown in the prior art, a need has arisen for a printing apparatus that is specifically adapted to print identification information on lottery tickets. This need has resulted from the institution by several state governments of state controlled lotteries as a method of raising revenue. Such lotteries typically take the form of small tickets that may be purchased by a player; each ticket carries prize information hidden by an opaque material that is readily removed from the ticket by scratching the ticket with a coin or other rigid object. Sellers of these tickets are often required to stamp an identification number on the back of each ticket so that the state may monitor the sales of the winning lottery tickets as well as for other identification purposes.

The problem that has confronted many businesses, such as grocery stores, filling stations and the like, is that they must hand stamp a large number of these lottery tickets. Hand stamping the tickets is time consuming and expensive where a business must pay an employee to perform this simple task. Some businesses have tried various printing devices to automatically print an identification number on each ticket, but two significant problems have been confronted. First, since the lottery tickets are normally connected in a long sequential series, a problem has arisen in the lack of ability for the identification number to be stamped at a precise location on each consecutive ticket. A second, and more significant problem, is that conventional printing apparatus often removes portions of the opaque masking material so that a portion of the hidden prize information is exposed. Naturally, this ruins the tickets so that they must be returned and destroyed resulting in a financial loss and in an increase in administrative time for the lottery.

Accordingly, a need has recently arisen for a printing apparatus that is simple in construction so that it may be inexpensive in manufacture, thus allowing small businesses to purchase the printing apparatus. A need has also arisen for a simply constructed printing apparatus that can print identification information on a delicate print media, such as lottery tickets at a precise location and without marring the print media.

SUMMARY OF THE INVENTION

It is an object of the present invention to provide a novel and useful printing apparatus that is simple in construction and economical in manufacture.

It is another object of the present invention to provide a printing apparatus adapted to precisely print information on a stream of print media without damaging the integrity of the print media.

Yet another object of the present invention is to provide a printing apparatus especially adapted to print business identififying information on a consecutive stream of lottery tickets without damaging opaque masking material located on those tickets.

Still a further object of the present invention is to provide a printing apparatus wherein a freely floating platen roller is adjustably biased against a print roller so as to accomodate different thickness in the print media as it is passed between the rollers.

It is still a further object of the present invention to provide a printing apparatus for printing an accordian array of cards, such as a set of lottery tickets, wherein the printing rollers interact with a feed rack, a feed table and a take-up rack so that the accordian array of cards is unstacked, printed and restacked automatically.

To accomplish these objects, the preferred embodiment of the present invention includes a print roller that is rotatably journaled between a pair of upright supports with the print roller being driven by an electric motor. The print roller carries printing elements that may be contacted by an inking roller that is pivotally movable into and out of vertical abutment with the print roller. A freely floating platen roller is rotatably journaled between a pair of movable supports that are preferably supported by elongated lever arms that are pivotally secured to a fulcrum element. Adjustable springs pivot the platen roller into contact with the print roller and these rollers are movable into and out of abutment with one another either manually or through a manual cam arrangement. Interlocking gears connect the platen roller to the print roller so that the platen roller is positively driven by the motor through these gear elements.

Where the print media is in the form of an accordian array of cards, the printing apparatus includes a feed rack supporting an unprinted array of cards that is upstream of the print and platen rollers a distance greater than the length of one card. A feed table is mounted between the print and platen rollers and the feed rack so that it supports a print media card immediately prior to introduction to the printing operation. A take-up rack is located a distance downstream of the print and platen rollers that is slightly less than the length of a card, and an inclined stop helps stack the printed cards into an accordian array in the take-up rack. An indexing hub is located on the print roller axle so as to permit easy alignment of the printing element or elements such that they will precisely print identifying information at selected locations on the print media. The motor is switched both by a constant action switch or by an intermitent switch to allow an operator to manually pulse the printing apparatus when the constant switch is in the "off" position. The printing apparatus is preferably mounted on a series of hinged surfaces that may be folded together in a box-like configuration that includes a handle so that the apparatus is readily stored in a compact form and is easily transportable.

These and other objects and advantages of the present invention will become apparent to those skilled in the art after considering the following detailed specification which discloses the preferred embodiments thereof in conjunction with the accompanying drawings, wherein:

DETAILED DESCRIPTION OF THE PREFERRED EMBODIMENT

The present invention relates to a printing apparatus that is adapted for printing information on a stream of print media such as that found in an accordian array of print cards which correspond to lottery tickets used by some states. In the preferred form of the present invention, the printing apparatus includes a novel print roller assembly mounted on a foldable support surface which also supports a feed rack, a feed table, a take-up rack and guide structure. The print roller assembly is driven preferably by an electric motor that includes an intermitent activation switch as well as a normal on/off switch.

Figure 1:
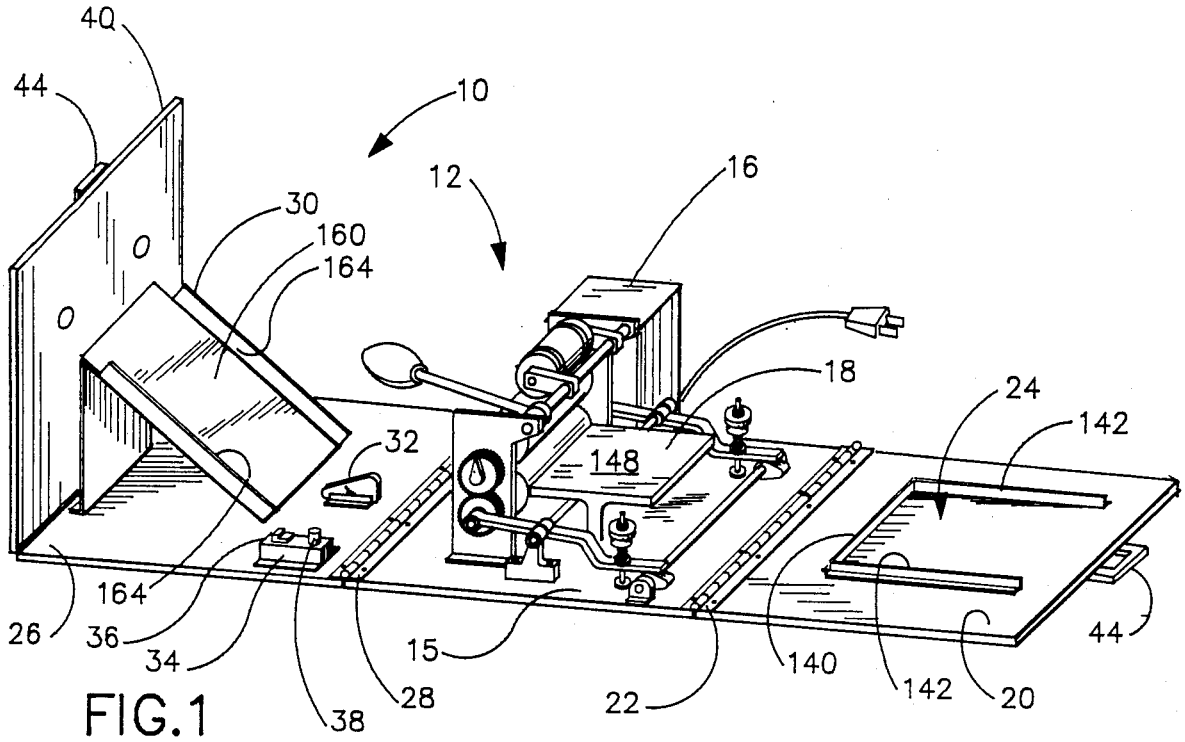
FIG. 1 is a perspective view of the printing apparatus according to the preferred embodiment of the present invention.

As is shown in FIG. 1, printing apparatus 10 includes a printing assembly 12 mounted on a support surface 14. Support surface 14 is defined by a bottom support element 15, a first side support element 20, and a second side support element 26. Bottom support element 15 also mounts a drive motor 16 which is mechanically connected to printing assembly 12, and a feed table 18 is mounted to support element 15 and is located immediately upstream of printing assembly 12.

A first side support element 20 is pivotally connected to bottom support element 15 by means of a piano hinge 22. First side support element 20 mounts a feed rack 24 that is aligned with feed table 18 when support elements 15 and 20 are coplanar. A second side support element 26 is pivotally connected to support element 15 by means of piano hinge 28. Second side support element 26 mounts a take-up tray 30 and a guide fin 32 that are each aligned with feed rack 24 and feed table 18 when support elements 15, 20 and 26 are coplanar. Second side support element 26 also mounts a switch assembly 34 that includes a constant on/off switch 36 and an intermediate or pulse switch 38 that are electrically connected to motor 16. A top wall support element 40 is rigidly connected perpendicularly to second support element 26.

Figure 4:
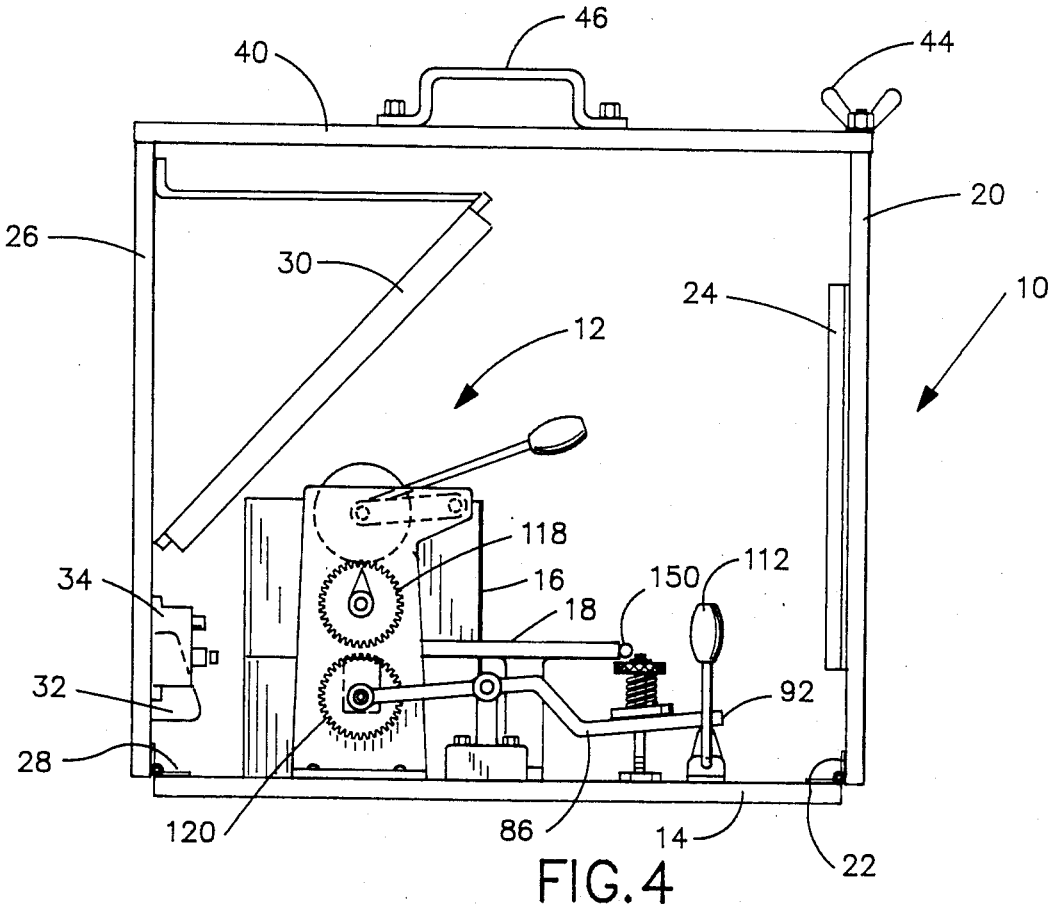
FIG. 4 is an end view in elevation showing the support structure and printing apparatus of the preferred embodiment of the present invention folded into a compact storage mode.

As is shown in FIG. 4, the foldable construction of printing apparatus 10 about hinges 22 and 26 allow printing apparatus 10 to be conveniently folded into a stored or transport position. To this end, as is shown in FIG. 4, first side support element 20 and top support element 40 are provided with latching members 42 and 44 which allow support elements 20 and 40 to be releaseably secured to one another thereby defining a boxlike configuration. Support element 40 also mounts a handle 46 to permit ready manual transport of printing assembly 10.

Figure 2:
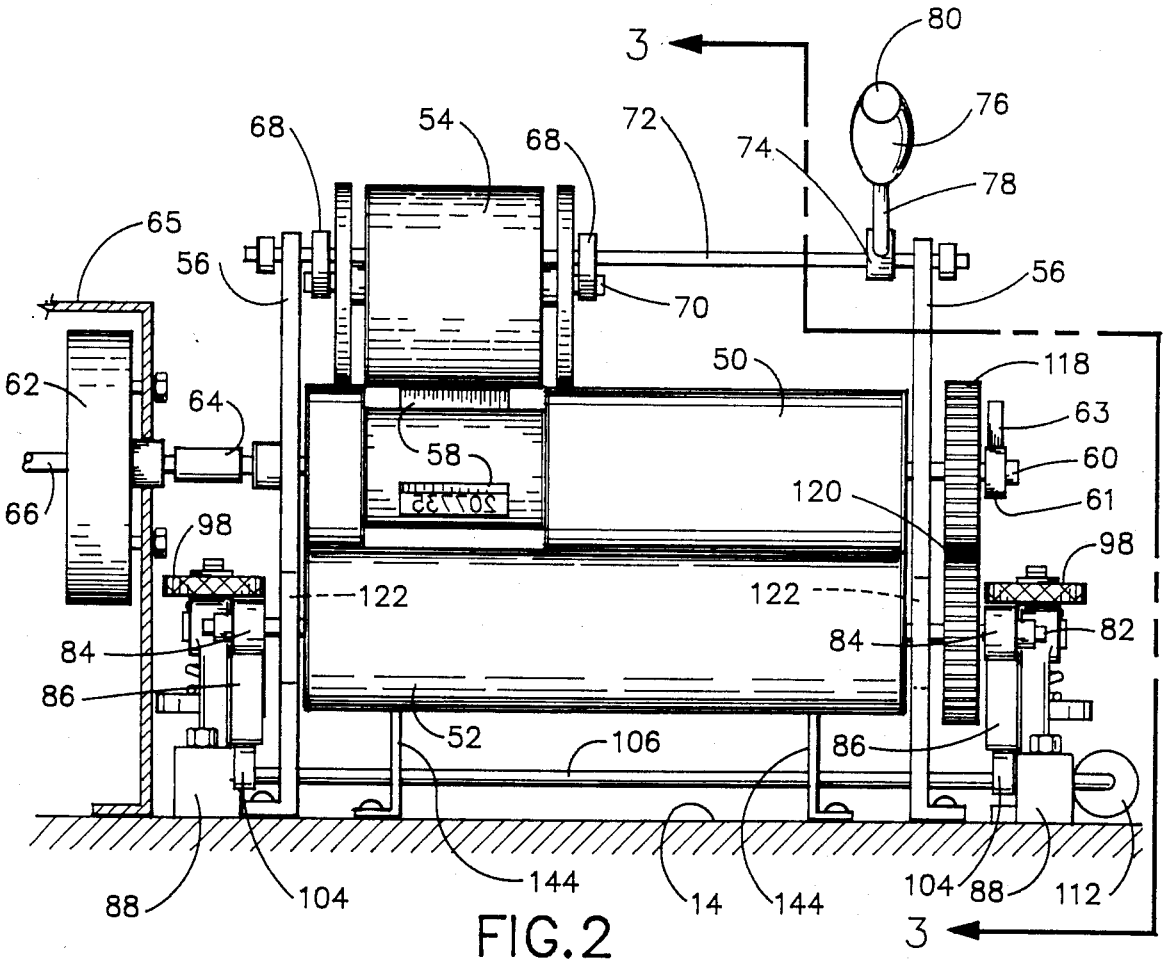
FIG. 2 is a rear elevational view in partial cross-section showing the printing roller assembly according to the preferred embodiment of the present invention.
Figure 3:
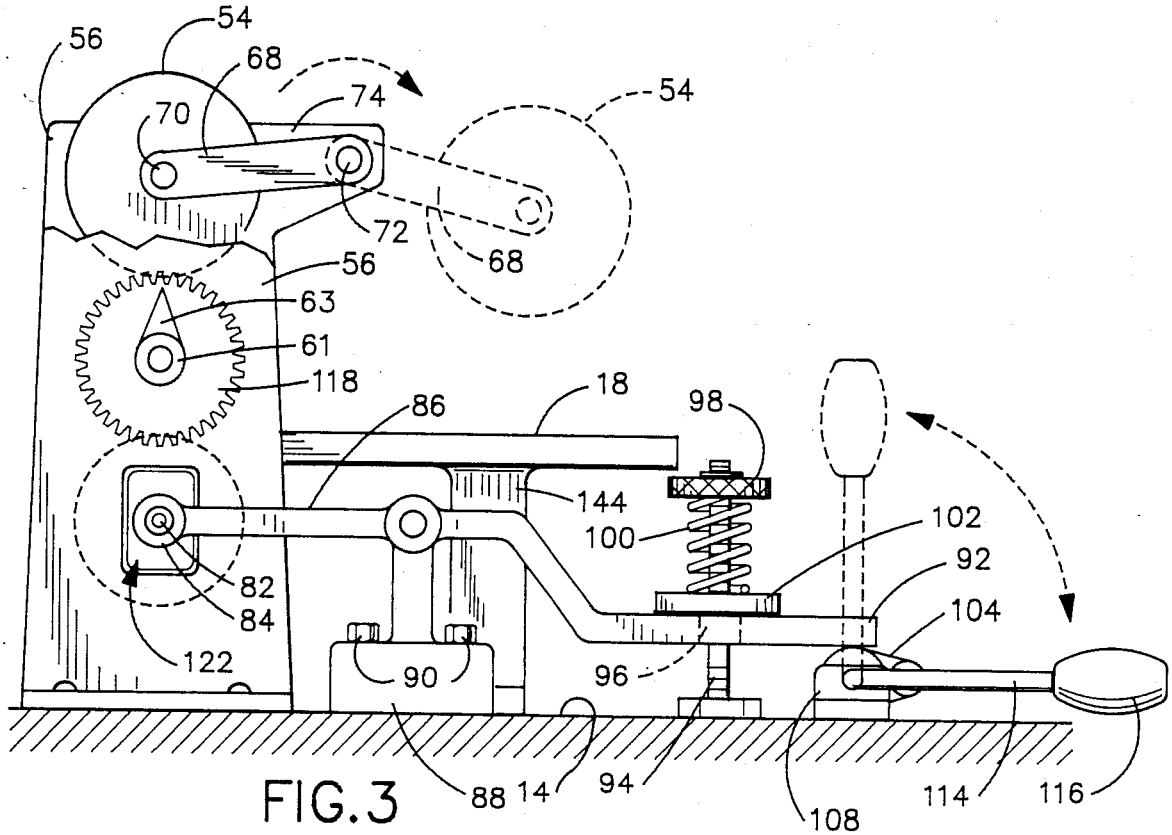
FIG. 3 is a left end elevational view taken in partial cross-section about line 3—3 of FIG. 2.

Printing assembly 12 is shown in greater detail in FIGS. 2 and 3 and primarily includes a print roller 50, a platen roller 52 and an inking roller 54 that cooperate with one another as described below. Print roller 50 is rotatably journaled between a pair of vertical upright support members 56, and print roller 50 carries printing elements 58 in a recessed portion formed at one end thereof. Thus, print roller 50 is mounted upon a rotatable axle 60 that extends between supports 56 and is coupled, at one end, to a gear box 62 by means of coupling 64. Gear box 62 is mounted to support surface 14 by means of housing 64 and includes a drive shaft 66 that is connected to motor 16. Motor 16 thus rotatably drives roller 50.

Inking roller 54 is rotatably journaled between a pair of parallel ink roller supports or armatures 68. One end of each armature 68 is connected to ink roller axle 70 which rotatably mounts ink roller 54, while the other end of each armature 68 is rigidly connected to pivot axle 72 that is rotatably journaled between supports 56. To this end, each support 56 includes a laterally projecting shoulder 74 at an upper end thereof with pivot axle 72 extending between shoulders 74, as is shown in FIG. 3. Ink roller 54 is thus movable into and out of vertical abutment with print roller 50 by rotating pivot axle 72 to pivot ink roller 54 into and away from print roller 50 as is shown in phantom in FIG. 3. To this end, a locking hub 74 is secured to pivot axle 72. A pivot handle 76 having a shaft 78 and an enlarged head 80 is secured to pivot hub 74 so that an operator may manually rotate pivot axle 72 thereby pivoting inking roller away from and into abutment with print roller 50.

Platen roller 52 is freely floating on an axis of rotation defined by platen axle 82 that is not connected to supports 56. As is seen in FIGS. 2 and 3, axle 82 is rotatably journaled between bearing ends 84 of a lever arm 86.

Each lever arm 86 is supported at its mid portion by means of a fulcrum element 88 that is attached by screws 90 to support surface 14. Each lever arm 86 terminates at a leverage end 92 opposite bearing end 84 with leverage ends 92 being formed as flat, plate-like elements in planes generally parallel to surface 14. Thus, it should be appreciated that, as leverage ends 92 are raised and lowered, bearing ends 84 are lowered and raised to move axle 82 and thus platen roller 52 into and out of abutment with print roller 50.

To accomplish the pivoting of each lever arm 86 about is fulcrum element 88, an adjustable bias means and cam assembly are provided at each leverage end 92. As is shown in FIG. 3, a threaded bolt 94 is rigidly affixed to support surface 14 and extends through a bore 96 in leverage end 92. An adjustable thumb screw 98 is threaded on the free end of bolt 94 so that it may be moved upwardly and downwardly along bolt 94, and a spring 100 is positioned between thumbscrew 98 and washer 102 which abuts leverage end 92. Thus, spring 100 urges leverage end 92 downwardly so as to bias bearing end 84 upwardly. This urges platen roller 52 (shown in phanton) into abutment with print roller 50.

In order to disengage platen roller from print roller 50, a cam element 104 is mounted underneath each leverage end 92 by means of a transverse axle 106 that rotatably extends between a pair of brackets 108 that are mounted by screws 110 to support surface 14. Axle 106 may be partially rotated in brackets 108 by means of a manual handle 112 that has a shaft 114 formed as a right-angle extension of axle 106 and which terminates in an enlarged head 116. As is shown in phantom in FIG. 3, handle 112 may be pivoted through 90 degrees of motion to cause cams 104 to bear upwardly against leverage ends 92, thus compressing springs 100.

It should therefore be appreciated that platen roller 52 moves into and out of abutment with print roller 50 depending upon the position of cams 104. This movement also causes platen roller 52 to become positively driven by drive motor 16. Specifically, as is seen in FIGS. 2 and 3, drive motor 16 is coupled through drive shaft 66 to axle 60 in order to cause rotation of print roller 50. A print gear 118 is attached to axle 60 for common rotation therewith so that gear 118 is driven by drive motor 16. A mating platen gear 120 is attached to platen axle 82 for common rotation therewith and is movbale into and out of engagement with gear 118 by the pivotal action of lever arm 86. Thus, as is shown in FIG. 2, when platen roller 52 is moved into abutment with print roller 50, gear 120 is moved into engagement with gear 118. When drive motor 16 then turns print roller 50, gear 118 positively drives gear 120 so that platen roller 52 is positively driven. This prevents relative slippage of the print roller and platen roller with respect to one another so as to more precisely print information on the print media.

Gears 118 and 120 are shown disengaged in FIG. 4, where it should be appreciated that handle 112 has been pivoted to cause cams 104 to elevate leverage end 92 of each lever arm 86. To permit the vertical movement of platen roller 52 caused by the pivoting action of arm 86, an elongated opening 122 is provided at a lower end portion of each vertical support 56, as is shown in FIG. 3. It should be appreciated that gear 120 has been omitted in this figure so that slot 122 is more apparent.

In order to more efficiently handle a print media comprising of an accordian array of cards, various racks and trays are relatively positioned on support surface support 14. This structure can best be seen in FIG. 5 where a stack of print media 130 as shown positioned in feed rack 24. Each card has a length "L" measured in a direction that corresponds to the stream of cards through printing assembly 12. Each print card is also hinged by perforations to each of its adjacent cards so that it may be folded in a vertical stack in an accordian-like manner.

Feed rack 24 includes an upstanding rear rib or wall 140 and a pair of parallel upstanding ribs or sidewalls 142 extending perpendicularly from end wall 140 in a direction corresponding to the stream of material through printing assembly 12. Sidewalls 142 are spaced apart a distance slightly greater than a width of a print card measured transversely to the full stream of the print media so that stacks 130 can conveniently nest in feed rack 24 with a downstream edge abutting rear wall 140.

A feed table 18 is supported from surface 14 by means of a support bracket 144 at a height "H" that equals the height of the contact line between the printer roller 50 and platen roller 52 when they abut one another. Feed table 18 includes a pair of upturned flanges or sidewalls 146 located either side of the bottom wall 148 and is positioned between rollers 50, 52 and rear wall 140 of feed rack 24. A forward edge of bottom wall 148 is protected by a plastic channel 150 so that the print media is protected as it slides onto feed table 18. Rear wall 140 of feed rack 24 is located upstream of the plane P, that is defined by the rotational axes of print of rollers 50 and 52, a distance A that is greater than length L of a print card. Such is important to keep the print cards from jamming and they are consecutively pulled off stack 130 during the printing operation.

The ratio of the distance A to the length L of a print card, or A/L, has been found to be critical within a given range where the apparatus is used to print lottery tickets. The acceptable range for this ratio has been determined to be 1.4 to 1.7. Should the ratio be less than 1.4, the stacked array of cards will not unfold properly during the printing operation. Should the ratio exceed 1.7, the stream of cards may sag, thus allowing the edges of the apparatus to scrape the cards. This in turn may cause unwanted removal of the opaque masking material on the lottery cards.

A take-up assembly for the printed cards is located downstream of plane P and includes a take-up tray 30 that includes a bottom wall 160 mounted at an acute angle with respect to support surface 14. Bottom wall 160 has a forward edge 162 which is located adjacent support surface 14 and includes a pair of upstanding flanges or sidewalls 164 that are generally in line with sidewalls 142 and sidewalls 146 of feed rack 24 and table 18, respectively. The upper edge 166 of take-up tray 30 is elevated above print surface 14 by means of a vertical support bracket 168 that is mounted to support surface 14 and in a convenient manner.

Figure 5:
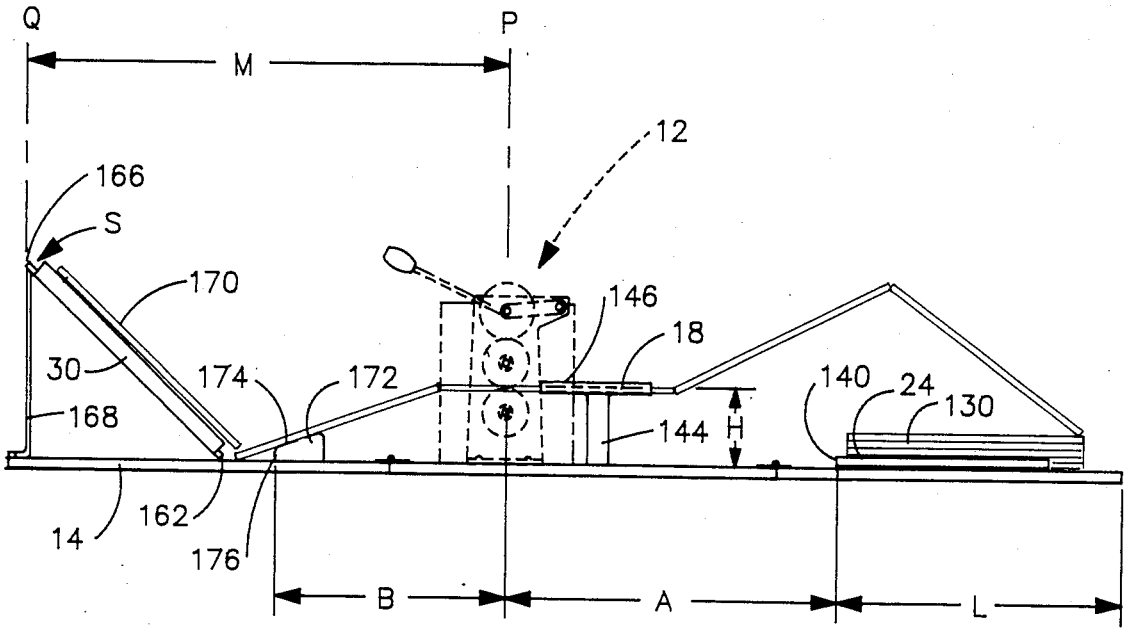
FIG. 5 is an end view in elevation of the feed rack, feed table and take-up tray according to the preferred embodiment of the present invention.

As is shown in FIG. 5, a printed stack 170 of cards is received by take-up tray 130 during the printing operation. To this end, it should be appreciated that the distance between edge 162 of take-up rack 30 and the line of contact between roller 50 and 52 in plane P is slightly greater than length L. Further, to aid in the take-up of the printed card a guide fin 172 is mounted on support surface 14 forwardly of edge 162 and downstream of printing assembly 12. Drive fin 172 has an angled upper edge 174 and terminates at a rearward end 176 located downstream a distance B from plane P that is less than length L. To this end, distance B should approximately equal L sin $\theta$, where $\theta$ is the angle between plane P and the plane containing edge 162 and the contact line between rollers 50 and 52. Support bracket 168 lies in a plane O that is parallel to plane P and that is spaced a distance M from plane P. A stack point S for the downstream edge of cards 170 is located adjacent plane Q so that it is also spaced a distance M from plane P. Again, it has been found that a perferred range M/L exists so that proper stacking occurs. Preferably, M/L is in the range of 1.9 to 2.2.

Operation of printing apparatus 10 can now be more fully appreciated for the foregoing in mind. When a user desires to print information on print media, such as an array of print cards, the apparatus is unfolded from the figuration shown in FIG. 4 so that it lays flat with panels 15, 20 and 26 oriented in a common plane to define a support surface 14. This assembly may be set on a counter or table top, and motor 16 may be plugged into a conveniently located electrical outlet. Ink roller 54 is pivoted away from print roller 50, and cams 104 are pivoted to disengage gears 118 and 120 and thus bring platen roller 52 out of contact with print roller 50. Ink is then applied to ink roller 56, and print roller 50 is manually turned by means of index hub 61 so that pointer 63 is pointing straight upward. Since pointed 63 denotes a position of the upper printing element 50, this provides for an alignment of the printing elements for purposes of printing information at a precise location on the print media.

Once ink roller 54 has been sufficiently soaked with a print fluid, it is pivoted back so that it will be in contact with printing elements 58 on print roller 50. It should be appreciated from FIG. 2 that ink roller 54 includes some axial space to allow for expansion of an absorbent ink pad that forms a typical construction of an ink roller. An array of cards may then be placed in feed rack 24 and the cards extended downstream across feed table 8 until the leading edge of the first card is aligned with plane P. At this point, cams 104 are rotated to allow engagement gears 118, 120 and abutment of print roller 50 and platen roller 52 so that the rollers slightly grip the edge of the first card therebetween. The tension by platen roller 52 may then be adjusted by turning by thumb screws 98, and the device is ready for operation. Preferably, the tension is adjusted up to five pounds, with best operation occurring at a pressure of four pounds.

The operator may then intermitently feed the cards through the printing assembly 12 by manually pushing button 38. Once it has been established that the printed information is located at a precise, desired location on the print cards, switch 36 may be initiated to constantly operate the print apparatus until all the cards in stack 130 are printed.

Figure 6:
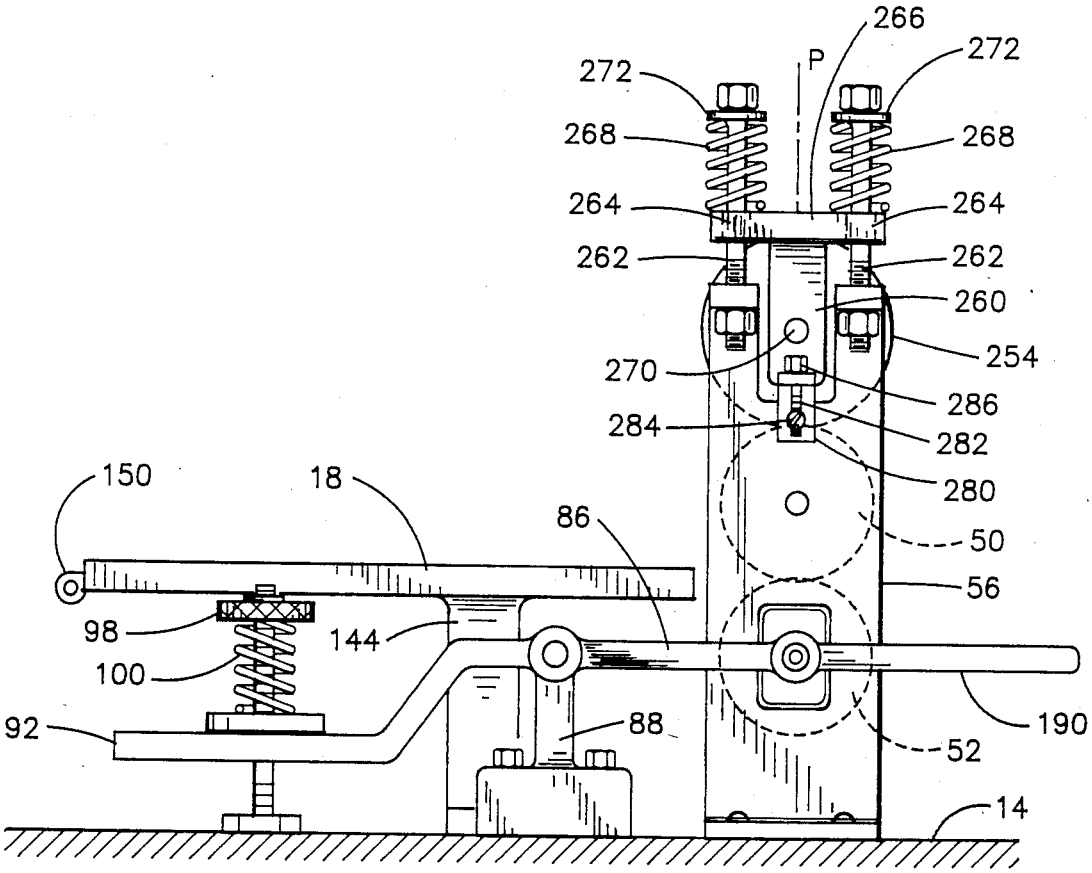
FIG. 6 is a right end elevational view of a first alternate embodiment of the printing roller assembly and feed table according to an alternate embodiment of the present invention.

While the above description is directed to the preferred embodiment of the invention, it is possible to change the structure without departing from the scope of the invention. Two such departures are shown in FIG. 6 which eliminates cam 104, cam axle 106 and handle 112, and alters the ink roller support structure. Here, an extension 190 is provided on each lever arm 86 with extension 190 extending through plane P on an opposite side of fulcrum elements 88. The cam elements are omitted and engaged and disengagement of gears 118, 120 and the movement roller 52 out of abutment with print roller 50 is simply accomplished by manually pushing down on extensions 190.

FIG. 6 also discloses an alternative assembly for biasing an ink roller against print roller 50. Here, ink roller 254 is mounted on an axle 270 which is rotatably journaled between a pair of slide brackets 260. Each slide bracket 260 is slidely mounted to a respective vertical support 56 by means of a pair of bolts 262 at an upper edge of each bracket 56. Bolts 262 pass through holes 264 formed in cross arm 266 of slide bracket 260, and a pair of springs 268 are mounted on each blot 262 above cross arm 266. Springs 268 are retained on these threaded bolts by means of nuts 272 so that downward tension may be applied on axle 270, thus adjustably maintaining ink roller 254 in abutment with print roller 50. Further adjustment of the position of axle 270 is provided by a slide adjustment element 280 which is mounted to support 56 by means of a locking screw 284 which passes through a vertical slot 282 formed in adjustment element 280. This element can be adjusted upwardly to abut nub 286 provided on bracket 260 so that it can provide a lower stop limit for slide bracket 260.

Figure 7:
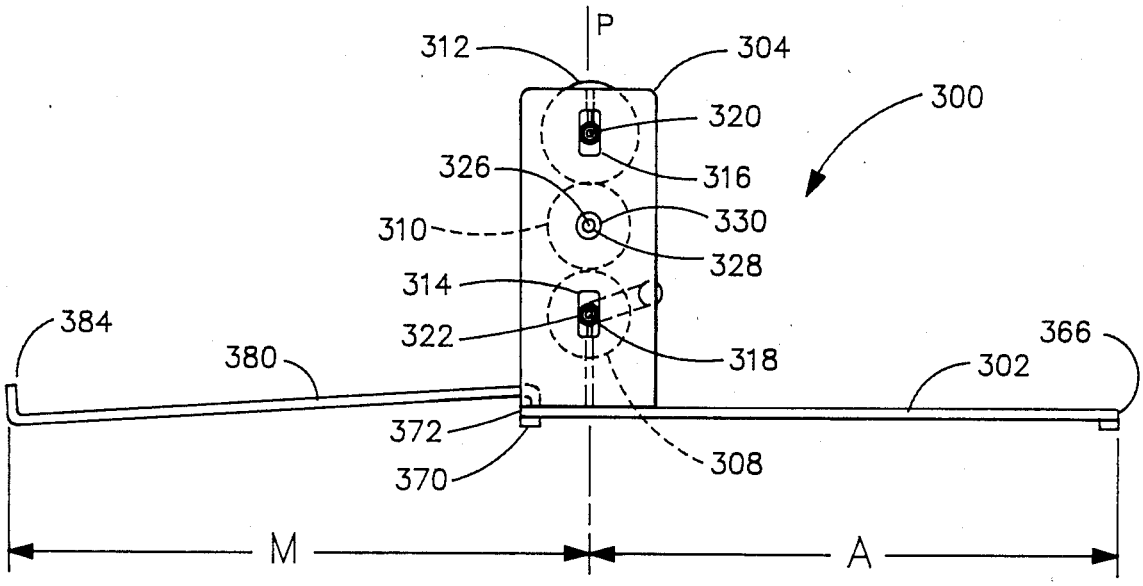
FIG. 7 is a side view in elevation of a second alternate embodiment of the printing apparatus according to the present invention.
Figure 8:
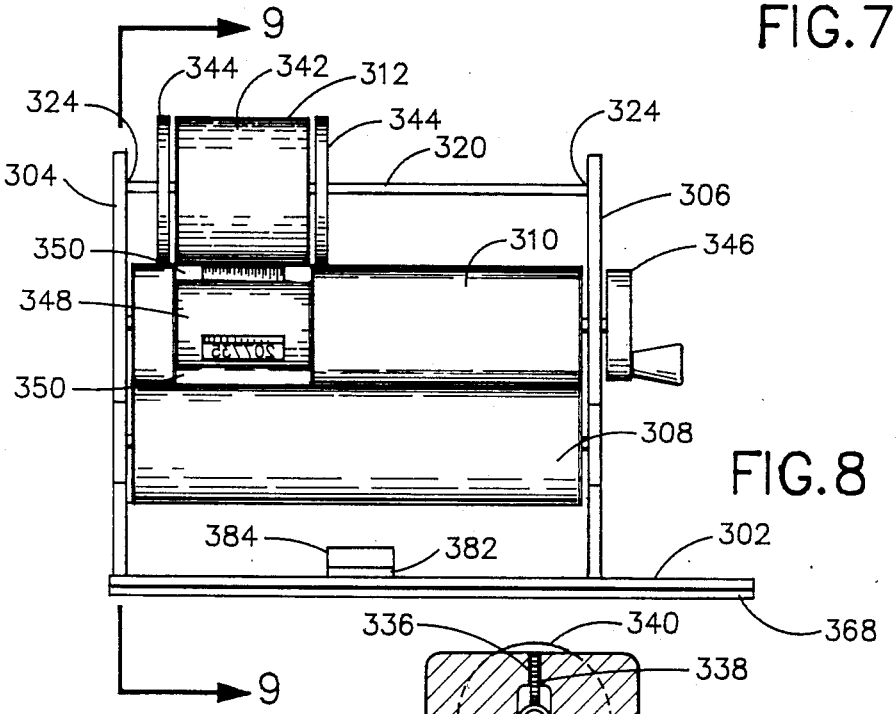
FIG. 8 is an end view in elevation of the printing apparatus shown in FIG. 7.
Figure 9:
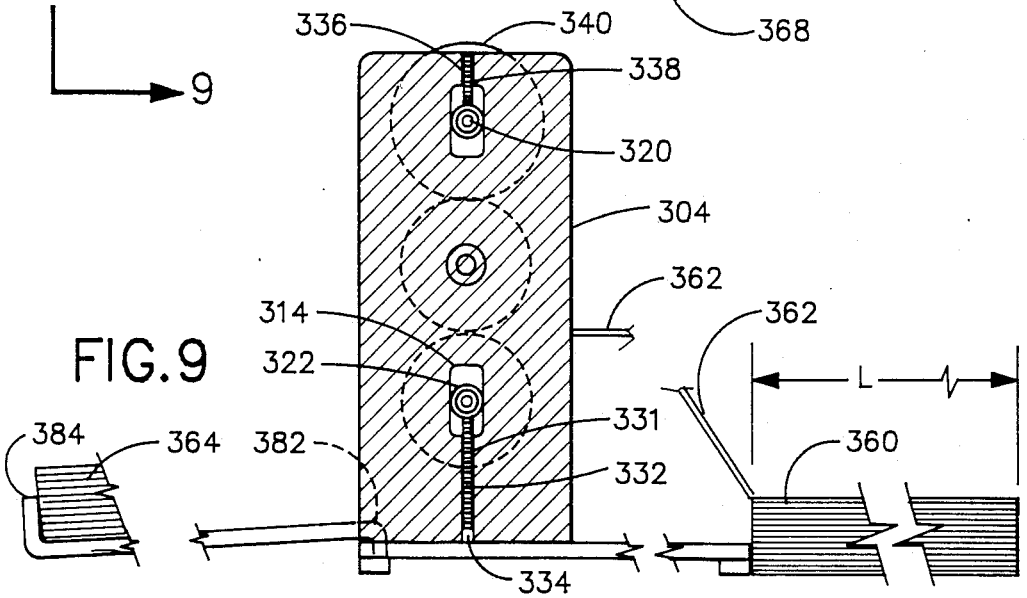
FIG. 9 is a cross-sectional view taken about line 9—9 of FIG. 8.

A second alternate embodiment of the present invention is shown in FIGS. 7, 8, and 9. This embodiment is a simplified, hand-crank unit that has been found to suitably print lottery tickets. As is shown in FIGS. 7 and 8, printing apparatus 300 includes a base support 302 to which is mounted a pair of vertical upright supports 304 and 306. Supports 304 and 306 mount a platen roller 308, a print roller 310, and an inking roller 312.

Each of supports 304 and 306 has a first slot 314 and a second slot 316 which mount axles 318 and 320 of rollers 308 and 312 respectively. Axle 318 is rotatably supported at each end by a guide bearing, such as bearing 322, which is slideably positioned in slot 314. Similarly, axle 320 is slideably positioned in slot 316 and held in position by clips 324. Print roller 310 has an axle 326 that is mounted between a pair of bearings, such as bearing 328 which is mounted in an opening, such as hole 330 formed in respective support 304, 306.

It should thus be appreciated that platen roller 308 has a freely floating axle 318 while axle 326 of print roller 310 is immovable with respect to upright supports 304 and 306. In order to tension platen roller 308 against print roller 310, a tensioning spring is provided in each of supports 304 and 306. As is shown in FIG. 9, support 304 includes a longitudinal bore 331 which intersects slot 314 at its lower edge. A tensioning spring 332 is mounted in bore 330 and has one end abuting guide bearing 322 with the other end held in position by means of a set screw 334. As noted with respect to the prefered embodiment, the pressure applied by platen roller 308 against print roller 310 is important. To this end, each set screw 334 is tightened so that platen roller 308 bears against print roller 310 with a force of between three and five pounds. Preferably, this force is set at approximately four pounds.

Ink roller 312 is mounted between supports 304 and 306 in a manner similarly to that described with respect to the platen roller 308. Each of supports 304 and 306 are provided with longitudinal bores, such as bore 336, and a spring 338 is mounted in each bore 336 with one end abutting axle 320 and the other end held in position by means of a set screw 340. Tension is applied by springs 338 sufficient to bear ink roller 312 against print roller 310. The force of this pressure, though, is not as critical as that with respect to the pressure between platen roller 308 and platen roller 310, due to the construction of ink roller 312.

Roller 312 is constructed of a soft, spongy material 342 flanked on either side by means of rigid plates 344 which bear against the cylindrical surface of print roller 310. Since print rollers 308 and 310 are constructed out of anodized aluminum, and since plates 344 are constructed as rigid metallic disks, it is necessary the sufficient force be applied to springs 338 to maintain plates 344 in contact with roller 310. Hence, roller 312 is rotated when roller 310 is driven, for example, by handcrank 346 which is secured to axle 326. The danger of overtensioning ink roller 312 against roller 310 is reduced since sponge material 342 is thus protected.

Print roller 310 is provided with a recessed portion 348 having a smaller diameter than the diameter of the main portion of roller 310. A printing element 350 extends circumferentially around reduced diameter portion 340, and it should be understood that the combined diameter of reduced portion 348 and printing element 350 is slightly larger than the diameter of roller 310 so that printing element 350 will contact spongy material 342. Thus, printing element 350 will continually receive printing fluid.

As noted with respect to the preferred embodiment, the present apparatus is designed for use in printing accordian-like arrays of cards that are hinged together at adjacent edges. Further, as noted above, the distance between the downstream edge of the unprinted stack of cards and plane P defined by axles 318, 320, and 326 can be as important. Likewise, the distance between plane P and the downstream point or edge of the restacked printed cards can be important so that proper feeding and take-up of the stream of cards is accomplished. To this end, as is shown in FIGS. 7 and 9, a stack of cards 360 is made up of individual cards 362, all of which have a length L. Cards 362 are pulled off of stack 360 and fed between rollers 308 and 310 and are restacked as a printed stack 364. To provide a downstream stop for stack 360 of cards 362, base 302 extends laterally of plane P to terminate at an edge 366 that is located a distance A from plane P. A support bar 368 extends across edge 366 underneath base 302 and cooperates with edge 366 in providing the downstream stop 436 for the stack of cards 360. Support bar 368 may be defined by a soft strip of material that may also act as a cushion for base 302. A similar support bar 370 may be provided at an edge 372 of base 302 opposite edge 366 so that base 302 will be supported in a parallel manner with respect to a horizontal support surface.

To provide a take-up stack 364 of printed cards 362, a narrow, elongated take-up arm 380 is releasably secured at one end 382 to base 302. Arm 380 terminates at its free end in an upturned finger 384 downstream of card stacks 364. Finger 384 acts as a limit stop for the printed cards as they are fed off of rollers 308 and 310, a finger 384 is spaced a distance M from plane P.

The operation of the device shown in FIGS. 7, 8, and 9 is similar to that with respect to the preferred embodiment. After proper tensioning has been set up for rollers 308 and 310, a stack 360 of cards to be printed are placed in abutting relationship to edge 366 of base 302. A leading edge of one card 362 is then fed between rollers 308 and 310, and drive handle 346 is manually turned to advance the cards therethrough. As handle 346 is turned, consecutive cards 362 are pulled off of stack 360 and printed with the desired information located on printing element 350. As this takes place, the leading edge of a card 362 abuts finger 384 and the printed cards are restacked on arm 380. As noted above, the ratio A/L has been found to preferably be in the range of 1.4 to 1.7 and the ratio M/L is preferably in the range of 1.9 to 2.2.

Embodiments of the present invention have been shown and described above with a degree of particularity to enable a complete understanding of those embodiments. However, it should be understood that the present invention involves inventive concepts defined in the appended claims, and these inventive concepts are not intended to be limited except insofar as the prior art requires. This printing apparatus may take other forms and is susceptible to various changes in detail without departing from the principles of this invention.

We claim:

1. A printing apparatus adapted to print information on an accordian array of print cards wherein each card has a length L with each card being hingedly connected to each adjacent card to define a stream of cards to be advanced through the printing apparatus, comprising a pair of vertical plate-like support members mounted to a support surface in generally spaced-apart, parallel planes;

a print roller rotatably journaled between said support members on a first axis and mounting printing elements thereon;

an ink roller rotatably journaled between a pair of ink roller supports on a second axis parallel to said first axis, said ink roller movable into an abutting relation with said printing elements;

a platen roller rotatably journaled between said support members on a floating axle parallel to said first axis, said support members permitting movement of said floating axle whereby said platen roller may be moved into and out of abutment with said print roller;

bias means on said support members for biasing said platen roller into direct radial abutment with said print roller;

a feed stop located upstream of said print and platen rollers a distance greater than the length of a card to be printed and operative to abut an edge of said accordian array of cards facing said vertical supports;

a take-up member mounted to said support surface downstream of said print roller and having a take-up stop located a distance from said print roller that is greater than the length of said cards by a factor of betwen 1.9 and 2.2; and drive means connected to said print roller for rotatably driving said print roller so that said cards are advanced between said print and platen rollers, said cards in said array being consecutively drawn against said feed stop to be unfolded from said accordian array, advanced between said print and platen rollers and then refolded against said take-up stop onto said take-up member.

2. Printing apparatus according to claim 1 including a first gear element on said print roller and a second gear element on said platen roller, said first and second gear elements moving into and out of engagement with one another when said platen roller is moved into and out of abutment with said print roller whereby said platen is rotatably driven by said print roller.

3. Printing apparatus according to claim 1 wherein said ink roller supports are slideably mounted on said supports members and include adjustable spring bias means for urging said ink roller into abutment with said print roller with an adjustably selected force, said ink roller supports having limit stop means for limiting the distance the ink roller may move with respect to said supports members in a direction toward said print roller.

4. Printing apparatus according to claim 3 including locking means on said ink roller supports for releasably securing said spring bias means at a selected force.

5. Printing apparatus according to claim 1 including a feed rack located upstream of said first and second rollers and having a pair of upstanding side walls and an upstanding rear wall and operative to hold the accordian array of cards, said rear wall defining said feed stop, and including a feed table located between said feed rack and said print and platen rollers and having a flat bottom wall and a pair of upstanding side flanges one on each side of the stream of said cards as they advance from said feed rack to said print and platen rollers, said flat bottom being positioned immediately upstream of said print and platen rollers, and a take-up tray located downstream of said print and platen rollers.

6. Printing apparatus according to claim 1 including a pair of movable supports defining said floating axle, a pair of lever arms and a pair of fulcrum elements secured to said support surface and each pivotally mounting a respective lever arm, one of said movable supports being located at a first end of each said lever arms, said bias means located at a second end of each said lever arm for pivoting said lever arms to cause said movable supports to position said platen roller in abutment with said print roller, each said fulcrum element being positioned at a midposition of its respective lever arm between the first and second ends thereof.

7. Printing apparatus according to claim 6 including a cam element on each said second end of said lever arms, said cam elements interconnected along a common axis of rotation and operative to pivot said lever arms against the force of said bias means to move said platen roller out of abutment with said print roller.

8. Printing apparatus according to claim 6 including an extension arm extending from each movable support longitudinally of its associated lever arm and operative to permit manual movement of said platen roller into and out of abutment with said print roller.

9. Printing apparatus according to claim 6 wherein said bias means includes force adjustment means for selectively varying the amount of force applied by said bias means on said lever arms within a range of three to five pounds.

10. Printing apparatus according to claim 1 wherein said support surface is defined by a foldable element including a support bottom, first and second support sides and a support top hinged together and foldable into a box-like configuration.

11. Printing apparatus according to claim 1 including an index hub mounted on the axis of said print roller and including index means for locating the rotary position of said printing elements.

12. Printing apparatus according to claim 1 wherein said drive means includes an electric motor having a first switch having a constant "on" and a constant "off" positions and an intermitent switch bias in an "off" mode.

13. Printing apparatus according to claim 1 wherein the distance between said feed stop and said print roller is greater than the length of a print card by a factor of between 1.4 and 1.7.

14. Printing apparatus according to claim 1 wherein said platen roller is bias against said print roller with a force of between three and five pounds.

15. Printing apparatus according to claim 1 wherein said support surface includes a base plate, said feed stop being formed by an edge of said base plate.

16. A printing apparatus adapted to print information on an accordian array of print cards wherein each card has a length extending in the direction it is fed in a stream through said printing apparatus and a width transverse to said length, comprising:

a pair of vertical plate-like support members mounted to a support surface in generally spaced-apart, parallel planes;

a print roller rotatably journaled between said support members on a first axis and mounting printing elements thereon;

an ink roller rotatably journaled on a second axis parallel to said first axis between a pair of substantially rigid, elongated armatures, one armature located on each side of said ink roller, said armatures pivotally secured to said support members whereby said ink roller may pivot between a first orientation whereby said ink roller and said print roller are in abutting relation and a second orientation whereby said ink roller is out of contact with said print roller and out of the vertical plane containing said first axis, said ink roller being positively supported by said armatures in the second orientation;

a platen roller rotatably journaled between a pair of platen supports on a floating axle parallel to said first axis, said platen supports being independent of said vertical supports, said platen support permitting movement of said floating axle whereby said platen roller may be moved into and out of abutment with said print roller;

spring bias means on said platen supports for biasing said platen roller into direct radial abutment with said print roller;

a feed table located upstream of said print roller and having a rear edge in closely-spaced relation to the line of contact of said print and platen rollers when they are in abutment with one another, said feed table having a width slightly greater than the width of said cards and a length slightly less than the length of one said cards;

a feed rack located upstream of said feed table, said feed rack having a pair of upstanding sidewalls operative to support side edges of said cards in said array parallel to the direction of feed and having a feed limit stop means for abutting an end edge of said array closer to said vertical plane;

a take-up tray mounted to said support surface downstream of said print roller and having a bottom wall oriented at an acute angle with respect to said support surface with a forward edge adjacent thereto, said forward edge located a distance from said line of contact that is greater than the length of said cards; and drive means connected to said print roller for rotatably driving said print roller whereby said cards in said array are consecutively drawn against said limit stop means to be unfolded from said array in said feed rack, across said feed table, between said print and platen rollers and refolded onto said take-up tray.

17. The printing apparatus according to claim 16 wherein said feed table having a pair of upturned side flanges for positively guiding said print cards therealong and having a forward edge protected by a plastic, channel member.

18. The printing apparatus according to claim 16 including an upright guide fin mounted to said support surface at a location between said vertical supports and said forward edge of said take-up tray in a plane generally parallel to the planes of said vertical supports.

* * * * *